US005323561A

United States Patent [19]

Yoshikawa et al.

[11] Patent Number: 5,323,561

[45] Date of Patent: Jun. 28, 1994

[54] BLASTING APPARATUS USING MIXTURE GAS AND POWDER

[75] Inventors: Takashi Yoshikawa, Kanagawa; Shigeo Kobayashi, Chiba, both of Japan

[73] Assignee: Sony Corporation, Japan

[21] Appl. No.: 65,430

[22] Filed: May 24, 1993

Related U.S. Application Data

[63] Continuation of Ser. No. 875,081, Apr. 28, 1992, abandoned.

[30] Foreign Application Priority Data

May 10, 1991 [JP] Japan ..... 3-133330

[51] Int. Cl.[5] ..... B24C 3/08; B24C 9/00; B24C 5/04

[52] U.S. Cl. ..... 51/417; 51/421; 51/424; 51/426; 51/439; 51/273

[58] Field of Search ..... 51/410, 417, 418, 419, 51/421, 424, 426, 427, 428, 439, 271, 268, 273

[56] References Cited

U.S. PATENT DOCUMENTS

| | | | |
|---|---|---|---|
| 2,195,810 | 4/1940 | Bower | 51/417 |
| 2,777,256 | 1/1957 | Paasche | 51/418 |
| 3,604,157 | 9/1971 | Fogle | 51/415 |
| 3,685,208 | 8/1972 | Richter | 51/417 |
| 4,624,080 | 11/1986 | Jakobsson | 51/427 |
| 4,630,410 | 12/1986 | Cavada | 51/415 |
| 4,674,239 | 6/1987 | Jodoin | 51/424 |
| 4,738,056 | 4/1988 | Suzuki | 51/421 |
| 4,787,178 | 11/1988 | Morgan | 51/418 |
| 4,793,103 | 12/1988 | Baumgart | 51/426 |
| 4,866,889 | 9/1989 | Golmann | 51/426 |
| 4,897,969 | 2/1990 | Balhorn | 51/418 |
| 4,908,998 | 3/1990 | Watkin | 51/426 |
| 5,117,366 | 5/1992 | Stong | 51/415 |
| 5,127,198 | 7/1992 | Nakayama | 51/424 |
| 5,138,800 | 8/1992 | Janusz | 51/424 |

FOREIGN PATENT DOCUMENTS

| | | | |
|---|---|---|---|
| 0002628 | 6/1979 | European Pat. Off. | 51/417 |
| 2605342 | 7/1977 | Fed. Rep. of Germany | 51/417 |

*Primary Examiner*—Bruce M. Kisliuk
*Assistant Examiner*—Bo Bounkong
*Attorney, Agent, or Firm*—Ronald P. Kananen

[57] ABSTRACT

A blasting apparatus for blasting a predetermined portion of a work by spraying a powder to the work in a blasting chamber. The blasting apparatus includes a work bed for placing the work thereon, a spray nozzle for spraying the powder onto the work, a first driving section for linearly moving the work bed in a first direction, and a second driving section for linearly moving the spray nozzle in a second direction perpendicular to the first direction. Accordingly, the blasting apparatus can be reduced in size.

39 Claims, 10 Drawing Sheets

BLASTING APPARATUS USING MIXTURE GAS AND POWDER

This application is a continuation of application Ser. No. 07/875,081 filed Apr. 28, 1992, abandoned.

BACKGROUND OF THE INVENTION

The present invention relates to a blasting apparatus for blasting a predetermined portion of an object or workpiece (hereinafter referred to as a work) by spraying a powder thereagainst.

A blasting apparatus is known as an apparatus for blasting a work by spraying or fusillading a powder of metal or inorganic material (particulate matter) against the work using high-pressure air. This technique is used to form minute blind holes or through holes in a circuit board, for example.

Such a blasting apparatus includes a work bed which receives a work thereon, a spray nozzle for spraying a powder against the work which is placed on the work bed, and means for moving the work bed. The work is previously masked so as to expose only those portions which are to be blasted. The work is moved in X and Y directions while the powder is sprayed against the work by the spray nozzle, thus effecting the blasting of the predetermined portion of the work.

However, in this type of conventional blasting apparatus, the spray nozzle is fixed and the work bed is moved in the X and Y directions. Therefore, the blasting apparatus is required to have an area in plan almost four times that of the work placed on the work bed, thus causing an enlargement in size of the blasting apparatus.

SUMMARY OF THE INVENTION

It is an object of the present invention to provide a compact blasting apparatus.

According to the present invention, there is provided a blasting apparatus for blasting a predetermined portion of a work by spraying a powder against the work while it is disposed in a blasting chamber. The blasting apparatus comprises a work bed for supporting the work thereon, a spray nozzle for spraying the powder onto the work, first means for linearly moving the work bed in a first direction, and second means for linearly moving the spray nozzle in a second direction perpendicular to the first direction.

With this arrangement, the work bed is moved in the first direction (X direction) only by a distance corresponding to the length of the work. Accordingly, the area of the blasting apparatus in plan can be reduced, and the blasting apparatus can be rendered compact.

It is preferable that the blasting apparatus further comprises a supply system for supplying the powder to the spray nozzle which includes a flexible tube connected to the spray nozzle. This is to enable the movement of the spray nozzle in the second direction (Y direction) to be easily effected.

It is preferable that the blasting apparatus further comprises a nozzle height adjusting mechanism for adjusting a height of the spray nozzle relative to the work. This is required so that, the distance between the spray nozzle and the work can be suitably set, and the degree blasting can be properly adjusted.

It is preferable that the blasting apparatus further comprises a sliding shaft for slidably supporting the work bed and a bellows-like cylindrical member for covering the sliding shaft. With this provision the deposition or penetration of the powder into a sliding mechanism consisting of the sliding shaft and a linear guide, can be prevented by the bellows-like cylindrical member. Meaning of a sliding surface between the sliding shaft and the linear guide can thus be prevented and accordingly prevent a reduction in accuracy due to looseness (play) in the sliding mechanism.

It is preferable that the first means and the second means are provided outside the blasting chamber. With this disposition, possible deposition or penetration of the powder into the first and second means can be prevented, and a reduction in durability of the first and second means can be prevented. This of cause promotes stable movement of the work bed and the spray nozzle.

It is preferable that the blasting apparatus further comprises a wire for connecting the work bed to the first means. With this arrangement, it is only necessary to form wire insert holes and insert a wire through a housing which defines the blasting chamber. The shieldability of the blasting chamber is therefore facilitated.

Other objects and features of the invention will be more fully understood from the following detailed description and appended claims when taken with the accompanying drawings.

DETAILED DESCRIPTION OF THE PREFERRED EMBODIMENT

Figure 1:
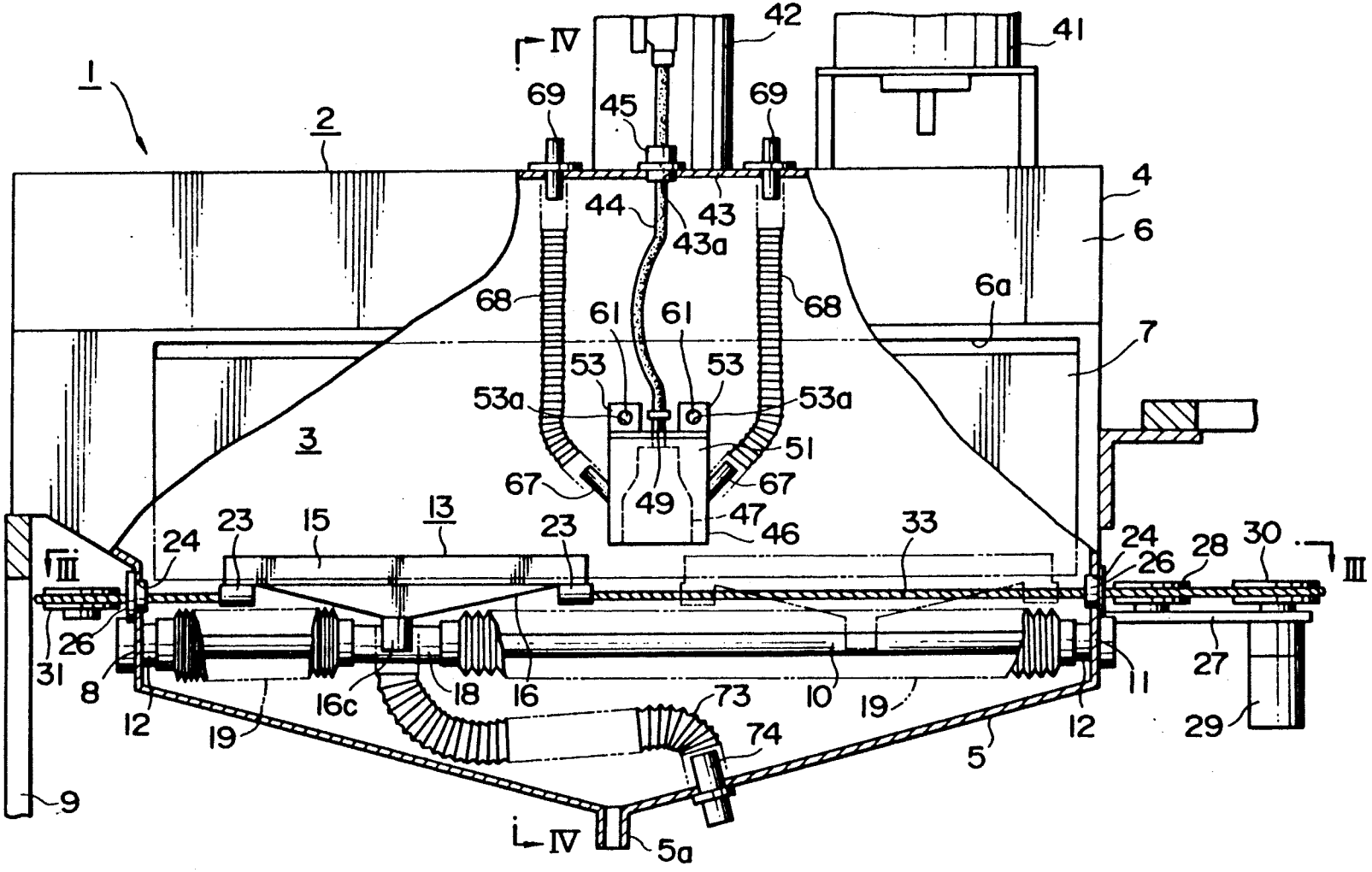
FIG. 1 is a front elevational view of showing an essential part of a preferred embodiment of the blasting apparatus according to the present invention with a housing partially cut away.
Figure 2:
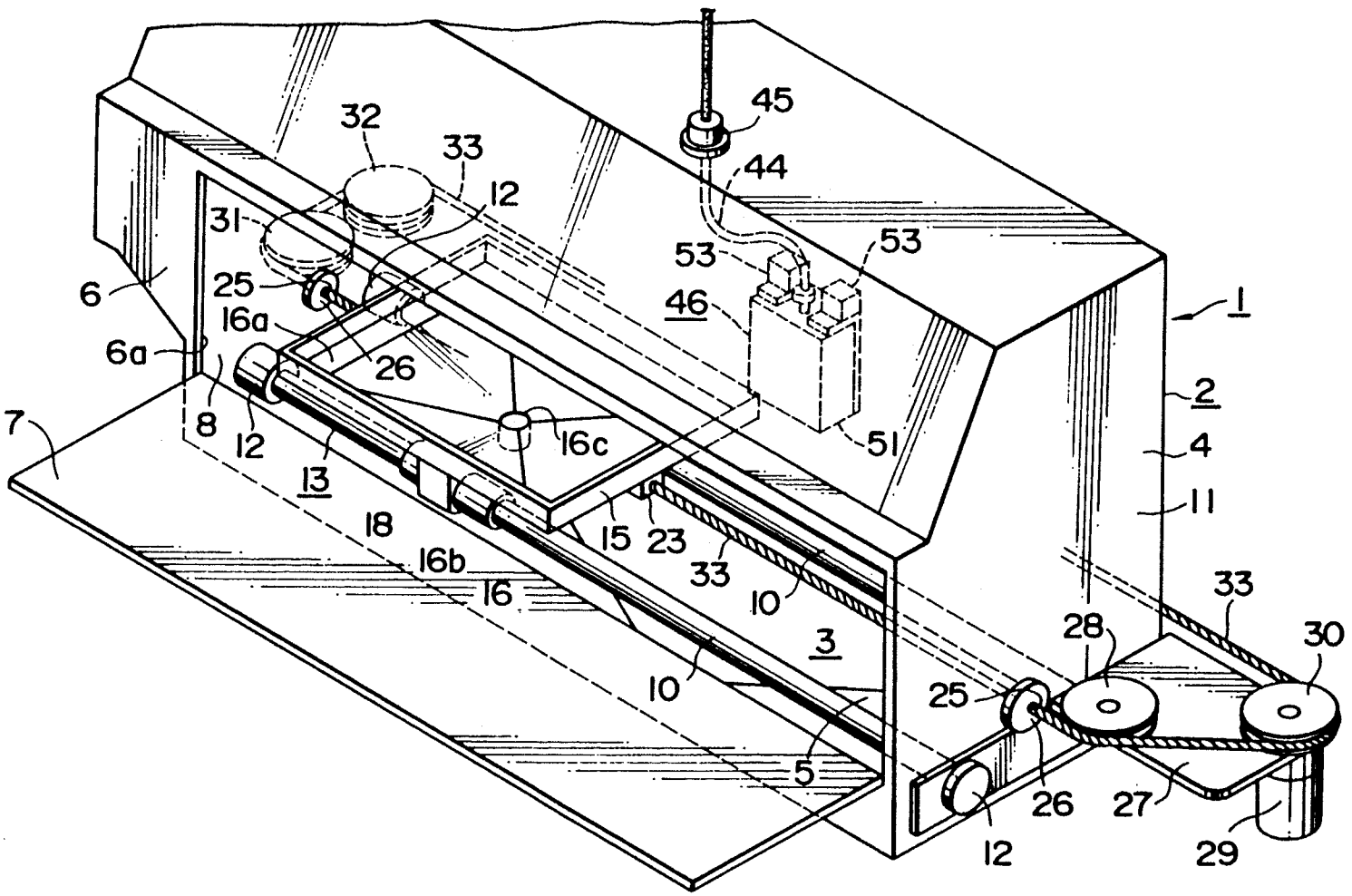
FIG. 2 is a perspective view of showing an essential part of the blasting apparatus with the housing partially cut away.

There will now be described a preferred embodiment of the blasting apparatus according to the present invention with reference to the accompanying drawings.

In the preferred embodiment illustrated, reference numeral 1 generally designates a blasting apparatus for blasting a substrate to form a fine through hole or blind hole in the substrate.

Reference numeral 2 designates a housing in which a work bed and a spray nozzle to be hereinafter described are movably provided. The housing 2 is formed of a sheet metal material. The internal space 3 of the housing 2 is substantially isolated from the outside.

In the following description, the terms of "right" and "left" represent the right and left sides as viewed in FIG. 1, respectively, and the terms of "front" and "rear" represent the opposite sides before and behind the sheet of FIG. 1, respectively. Further, the term of "lateral" represents the right and left direction of the housing 2, and the term of "transverse" represents the front and rear direction of the housing 2.

The housing 2 is elongated in the lateral direction. The housing 2 is generally comprised of a main portion 4 having a lower opening and a bottom portion 5 closing the lower opening of the main portion 4.

An upper half of a front side wall 6 of the main portion 4 is inclined frontwardly, and a lower half of the front side wall 6 is vertical. The lower half is formed with a work window 6*a* having a size just smaller than that of the lower half. The work window 6*a* is normally closed by a door 7.

The bottom portion 5 of the housing 2 is relatively flat such that it is formed like a funnel of an inverted quadrangular pyramid having an upper opening. The bottom portion 5 is formed at its bottom apex with a cylindrical hose connecting projection 5*a*. The upper opening of the bottom portion 5 is substantially registered with the lower opening of the main portion 4.

A left side wall 8 of the main portion 4 is formed at its lower end (as viewed from the front side) in such a manner as to be indented inwardly.

Reference numeral 9 designates a body frame of the blasting apparatus 1. The housing 2 is supported to a front portion of the body frame 9.

Reference numeral 10 designates a pair of guide shafts for movably supporting a work bed to be hereinafter described. The guide shafts 10 are arranged just above the bottom portion 5 in the housing 2 so as to extend in parallel to each other in the lateral direction. Four shaft fixing members 12 are mounted at the lower end portions of the left side wall 8 and the right side wall 11 of the housing 2. The opposite ends of the two guide shafts 10 are supported through the four shaft fixing members 12 to the opposite side walls 8 and 11 of the housing 2.

Reference numeral 13 designates a work bed on which a substrate 14 is to be detachably placed. The work bed 13 includes a moving base movably supported to the guide shafts 10 and a work table to be detachably supported to the moving base.

The lateral length of the main portion 4 of the housing 2 is about 2.5 times the lateral length of the work bed 13, while the transverse width of the main portion 4 is larger than the transverse width of the work bed 13 by a given amount.

Reference numeral 15 designates a moving base of the work bed 13. The moving base 15 is rectangular as viewed in plan so as to be elongated in the lateral direction. The moving base 15 is formed in a relatively thin box-shape having an upper opening. A bottom plate 16 of the moving base 15 is comprised of two horizontal portions 16*a* at the right and left end portions thereof and a relatively flat funnel portion 16*b* shaped like an inverted quadrangular pyramid. The funnel portion 16*b* is formed at its bottom apex with a cylindrical hose connecting projection 16*c*.

Four positioning pins 17 project vertically upwardly from the horizontal portions 16*a* at the front and rear ends thereof. Each positioning pin 17 is constituted by a small-diameter upper portion 17*a* and a large-diameter lower portion 17*b* having a diameter larger than that of the upper portion 17*a*.

Reference numerals 18 designate a pair of linear guides, e.g., linear ball bearings fixed to the front and rear end portions of a lower surface of the bottom plate 16 at a substantially laterally central position thereof. The two guide shafts 10 are respectively inserted through the two linear guides 18. Thus, the moving base 15 is supported on the guide shafts 10 so as to be movable in the axial direction of the guide shafts 10, that is, in the lateral direction.

Figure 6:
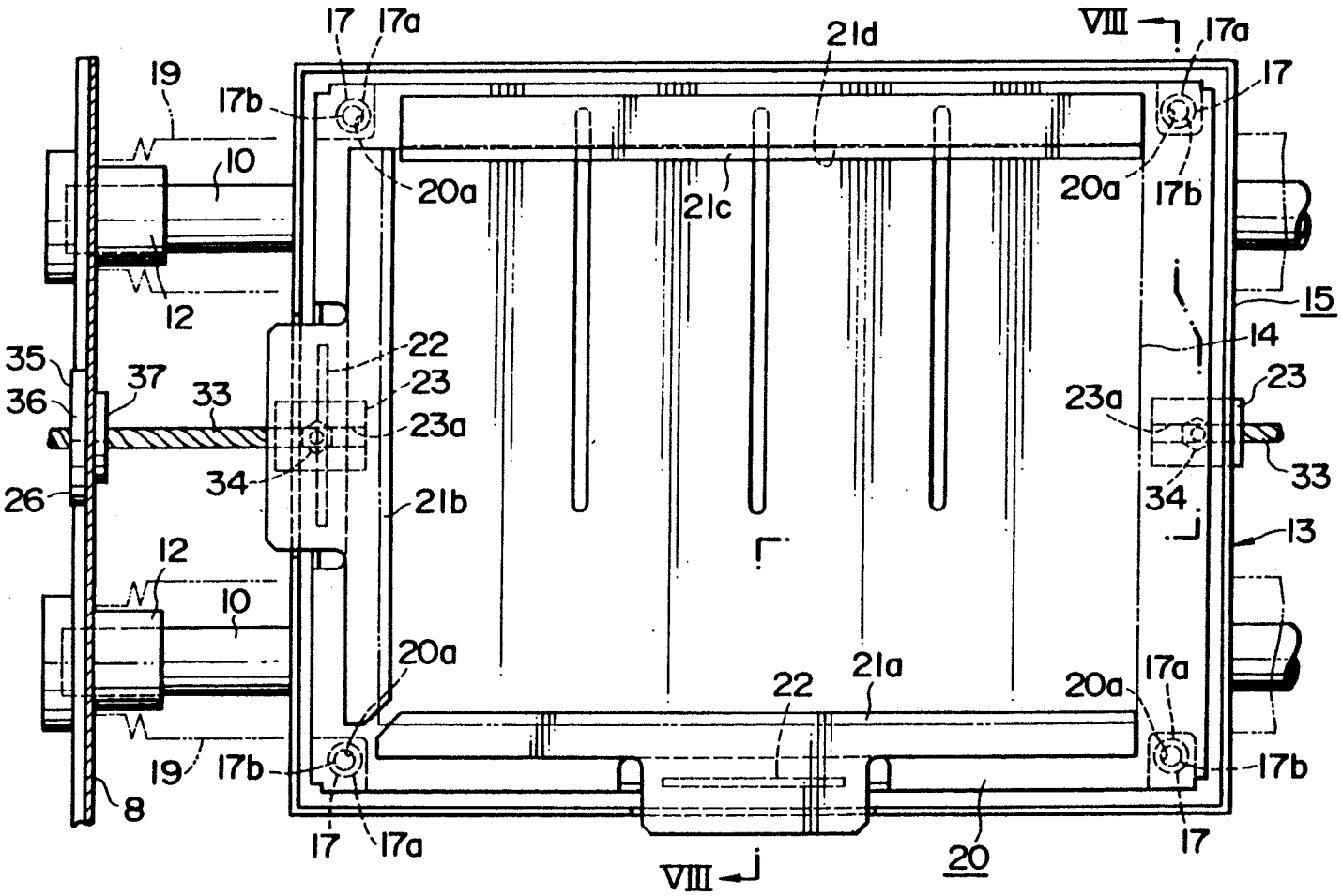
FIG. 6 is an enlarged plan view of an essential part including a work bed.
Figure 7:
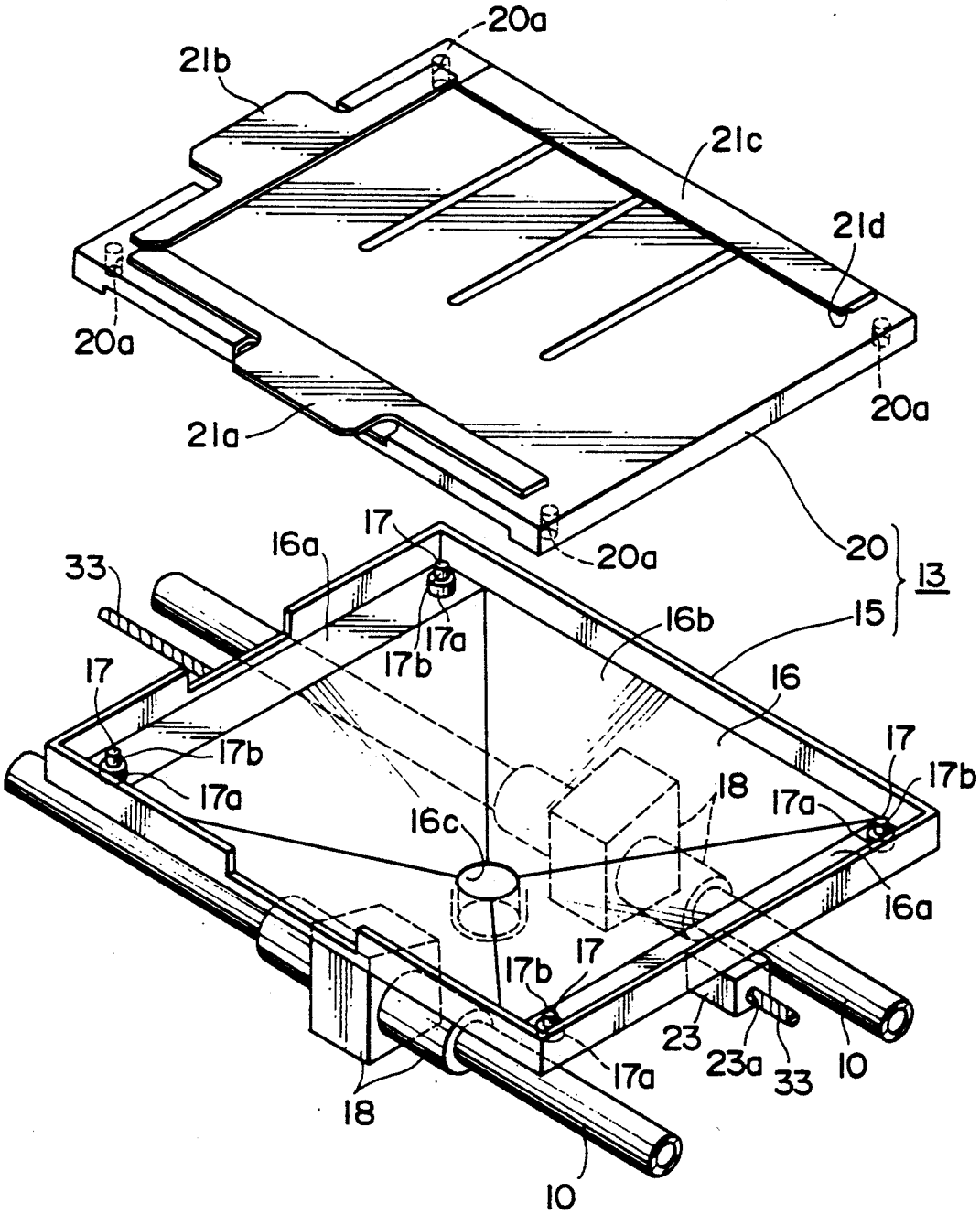
FIG. 7 is an enlarged perspective view of the work bed consisting of a moving base and a work table shown under the condition wherein the work table is removed from the moving base.
Figure 8:
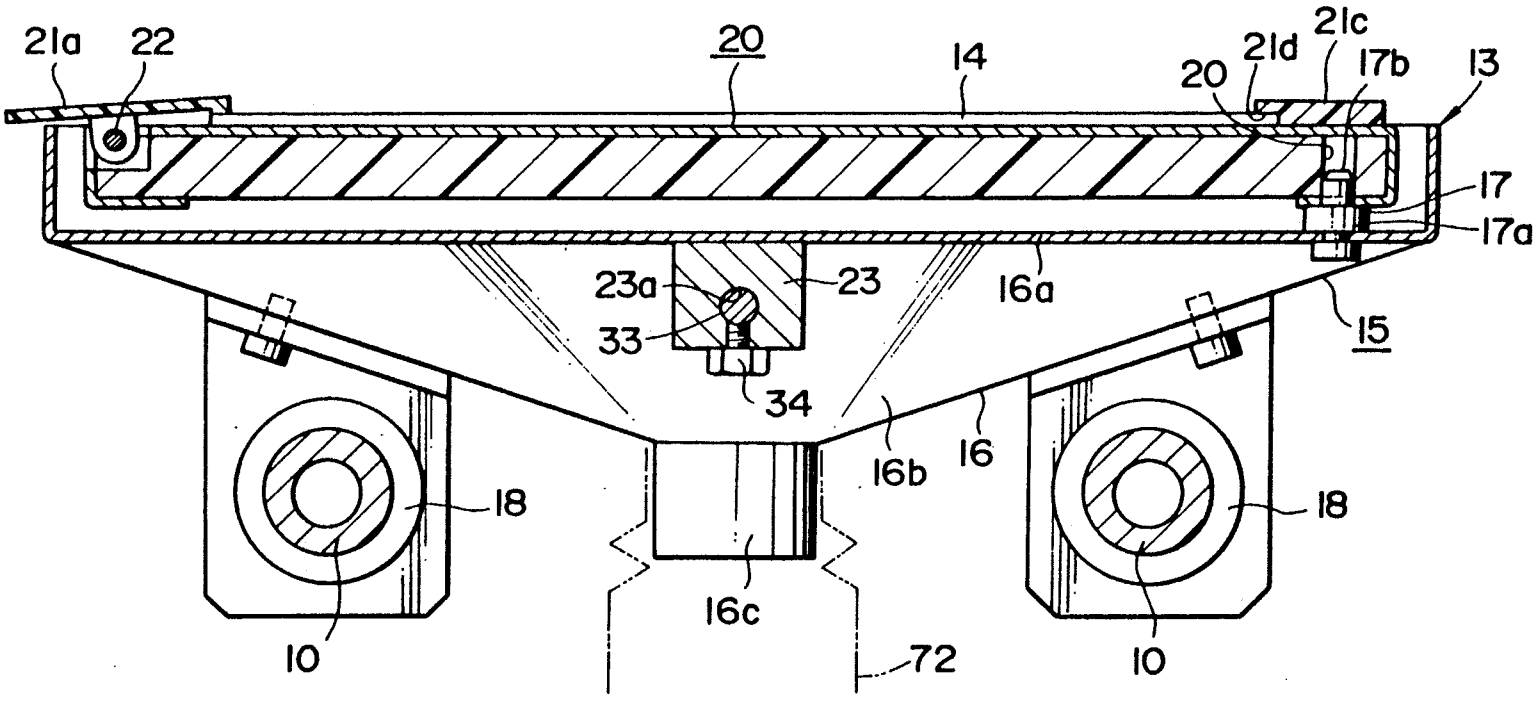
FIG. 8 is a cross section taken along the line VIII—VIII in FIG. 6.
Figure 9:
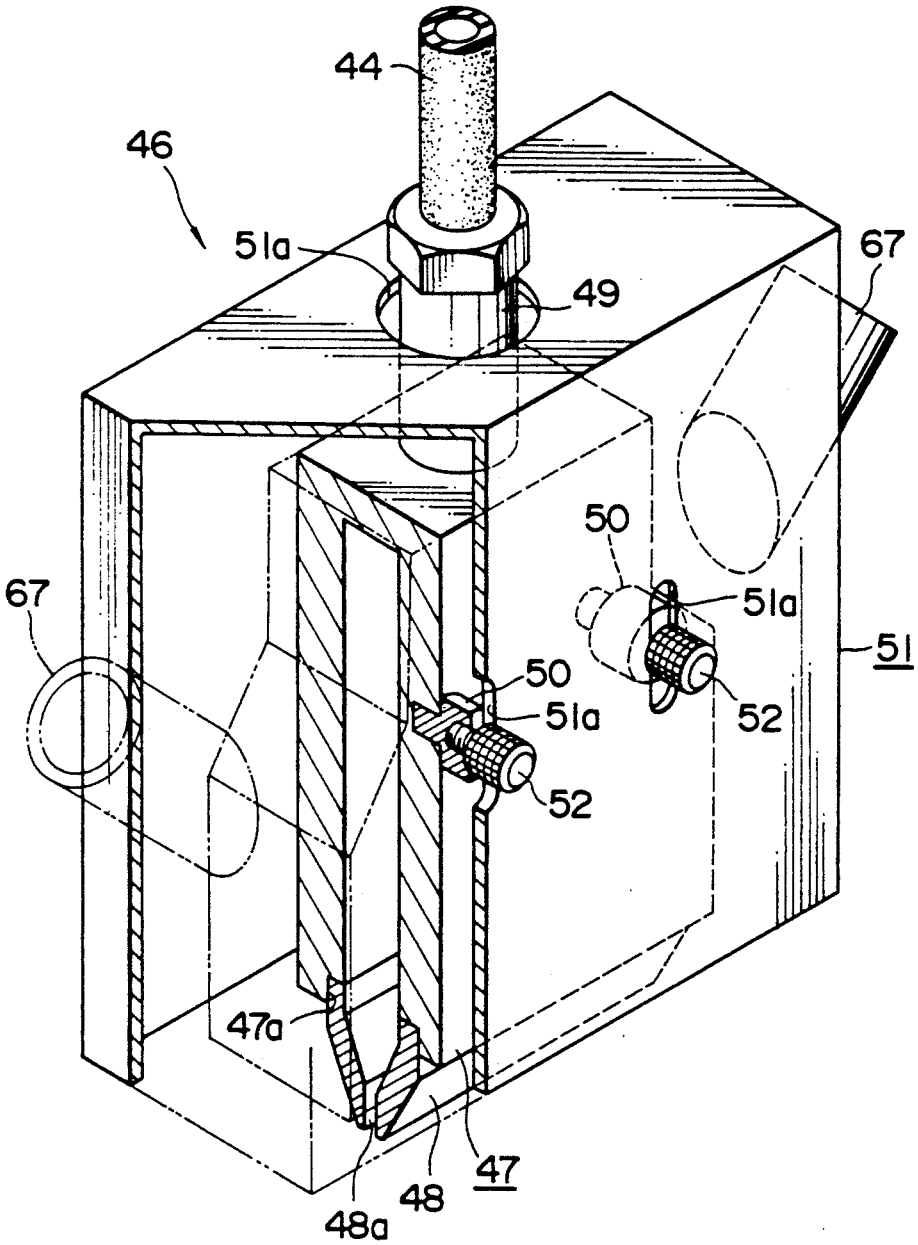
FIG. 9 is an enlarged perspective view showing a spray nozzle with a part thereof cut away.

Reference numerals 19 designate a plurality of bellows (corrugated) hoses (shown in FIGS. 1 and 6 only) provided so as to cover the guide shafts 10. One end of each bellows hose 19 is fixedly engaged with an outer circumference of a cylindrical outer case of each shaft fixing member 12 supporting the respective guide shaft 10, and the other end of each bellows hose 19 is fixedly engaged with an outer circumference of a cylindrical outer case of each linear guide 18 fixed to the bottom plate 16 of the moving base 15. Accordingly, an outer circumference of each guide shaft 10 and a guide shaft insert hole of each linear guide 18 are shielded by each bellows hose 19 to be protected from powder deposition.

Reference numeral 20 designates a work table of the work bed 13. The work table 20 is a rectangular flat member having an external form (as viewed in plan) which is just smaller than that of the moving base 15. A lower surface of the work table 20 is formed at its four corners with four positioning holes 20*a*.

In positioning the work table 20 to the working base 15, the upper portions 17*b* of the positioning pins 17 of the moving base 15 are inserted into the positioning holes 20*a* of the work table 20, and the lower opening edge portions of the positioning holes 20*a* are placed on the lower portions 17*a* of the positioning pins 17. Thus, the work table 20 is supported inside the moving base 15 so as to be positioned in the horizontal direction and the vertical direction.

Reference numerals 21*a* and 21*b* designate two substrate pressers or restraints located on an upper surface of the work table 20 at a front end portion and a left end portion thereof, respectively. The substrate restraints 21*a* and 21*b* are rotatably supported to respective supporting shafts 22 (see FIG. 6) provided in the work table 20 in such a manner that the inside edge portions of the substrate restraints 21*a* and 21*b* are movable in the vertical direction and that they are normally biased by respective torsion springs (not shown) mounted on the supporting shafts 22 to resiliently contact the upper surface of the work table 20.

Reference numeral 21*c* designates another substrate restraint provided on the upper surface of the work table 20 so as to be movable in the transverse direction. The substrate restraint 21*c* is formed at its front edge with an elongated recess 21*d* opening to the front side and the lower side and extending over the lateral width of the substrate restraint 21*c*.

The substrate 14 is held to the work table 20 by engaging a rear edge of the substrate 14 with the elongated recess 21*d* of the rear substrate restraint 21*c* and nipping a left edge and a front edge of the substrate 14 between the inside edge portion of the left substrate restraint 21*b* and the upper surface of the work table 20 and between the inside edge portion of the front substrate restraint 21*a* and the upper surface of the work table 20, respectively.

Various substrates having different sizes may be held by moving the rear substrate presser 21c in the transverse direction.

Further, mounting and demounting of the substrate 14 with respect to the work table 20 are effected under the condition that the work table 20 is removed from the moving base 15 with the door 7 opened.

Reference numerals 23 designate a pair of wire fixing members fixed to the lower surfaces of the horizontal portions 16a of the bottom plate 16 of the moving base 15 at the substantially central position in the transverse direction. Each wire fixing member 23 is formed with a wire insert hole 23a extending in the lateral direction, and it is further formed with a tapped hole 23b extending between a lower surface of the member 23 and the wire insert hole 23a.

Reference numerals 24 designate a pair of holes formed through the lower end portions of the left and right side walls 8 and 11 of the housing 2 at the positions opposed to the wire fixing members 23. Each hole 24 is closed by a sealing member 26 having a wire insert hole 25.

Reference numeral 27 designates a pulley mounting plate fixed to an outer surface of the right side wall 11 of the housing 2. A guide pulley 28 is rotatably supported to an upper surface of the pulley mounting plate 27 at a left front position thereof. A geared motor 29 is fixed to a lower surface of the pulley mounting plate 27 at a right rear position thereof, and a drive pulley 30 is fixed to an outer shaft of the motor 29. The drive pulley 30 is located at the same level as that of the guide pulley 28 over the upper surface of the pulley mounting plate 27.

Figure 3:
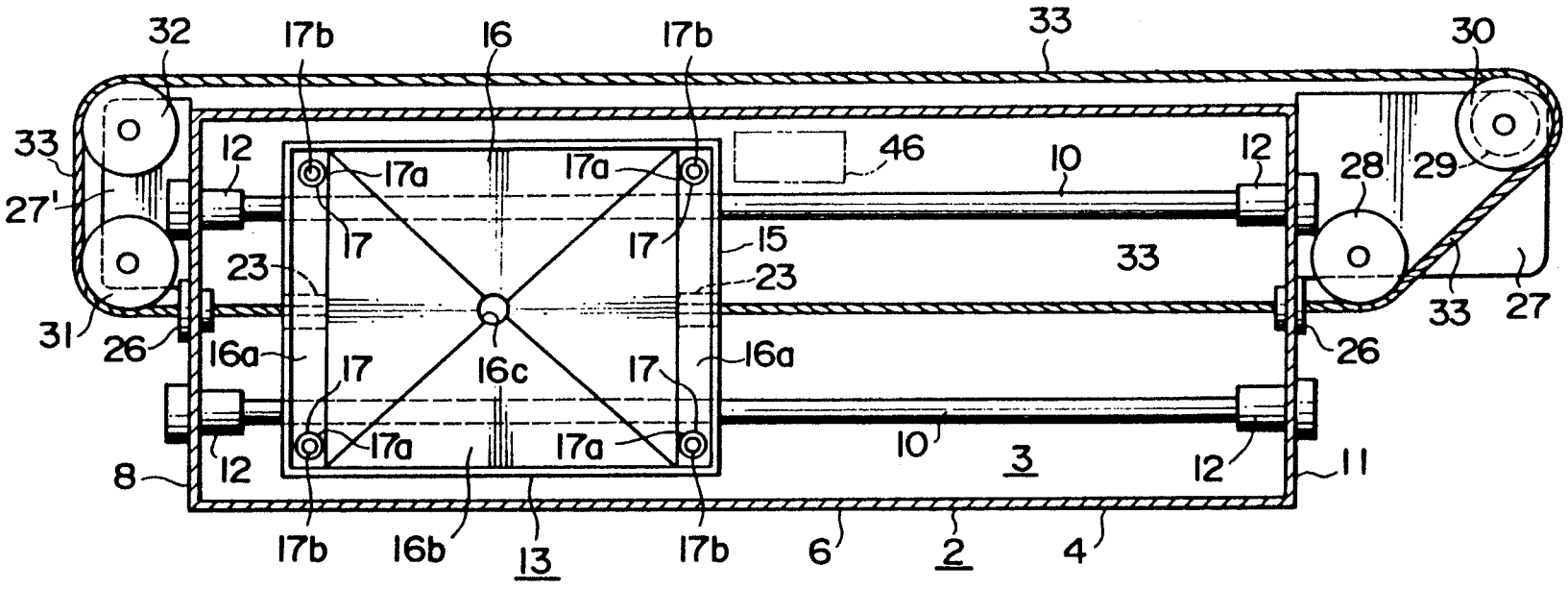
FIG. 3 is a cross-section taken along the line III—III in FIG. 1.

Reference numerals 31 and 32 designate two guide pulleys rotatably supported to a pulley mounting plate 27' (shown in FIG. 3 only) fixed to the left side wall 8 of the housing 2. The two guide pulleys 31 and 32 are located somewhat apart from each other in the transverse direction.

These guide pulleys 28, 31 and 32 and the drive pulley 30 are located at the same level as that of the wire insert holes 25 of the sealing members 26.

Reference numeral 33 designates a wire fixed at its opposite ends to the wire fixing members 23 fixed to the work bed 13. Thus, the wire 33 is made endless through the work bed 13. A substantially half portion of the wire 33 is drawn out of the housing 2 through the wire insert holes 25 of the sealing members 26, and is wound around the guide pulleys 28, 31 and 32 and the drive pulley 30.

The opposite ends of the wire 33 are inserted into the wire insert holes 23a of the wire fixing members 23, and are fixed to the wire fixing members 23 by means of two set screws 34 threadedly engaged with the respective tapped holes 23b.

When the motor 29 is rotated, the drive pulley 30 is rotated in the same direction to move the wire 33 in a direction according to the rotational direction of the motor 29, thereby moving the work bed 13 in the lateral direction.

The work bed 13 is movable between an initial position shown by a solid line in FIG. 1 and a terminal position shown by a phantom line in FIG. 1.

A suitable tension is normally applied to the wire 33 by a tensioner (not shown).

Figure 5:
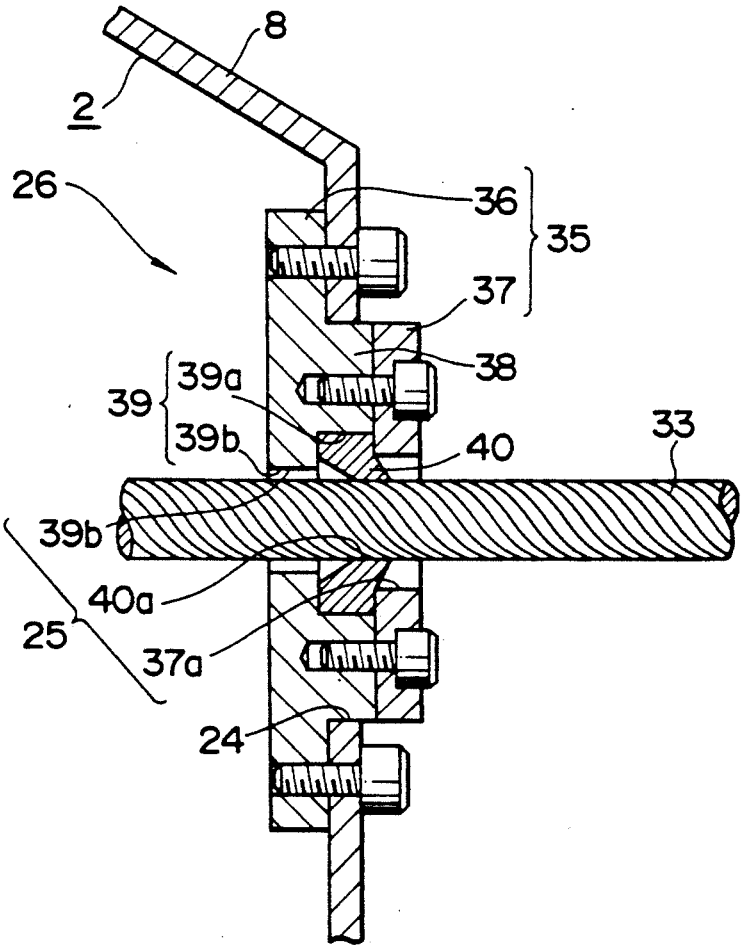
FIG. 5 is an enlarged vertical sectional view of a sealing member disposed in a wire insert hole of the housing.

Each sealing member 26 is comprised of a housing 35 and a packing 40 located in the housing 35 (see FIG. 5).

While FIG. 5 shows the left sealing member 26 only, the right sealing member 25 also has the same form and structure as those of the left sealing member 26. Accordingly, the explanation for the right sealing member 26 will be omitted hereinafter.

The housing 35 is comprised of a substantially disk-shaped outside half 36 projecting at its central portion inwardly of the housing 2 and a substantially disk-shaped inside half 37 somewhat smaller in size than the outside half 36 has an outer diameter substantially equal to a diameter of the hole 24 formed through the left side wall 8. The outside half 36 is formed at its central portion with a through hole 39 extending in the axial direction.

The through hole 39 of the outside half 36 is comprised of a large diameter portion 39a extending from the inside surface of the outside half 36 to the axially half portion thereof and a small diameter portion 39b extending from the large diameter portion 39a to the outside surface of the outside half 36.

The inside half 37 has an outer diameter equal to that of the projecting portion 38 of the outside half 36. The inside half 37 is formed at its central portion with a through hole 37a extending in the axial direction. The through hole 37a of the inside half 37 has a diameter somewhat smaller than that of the large diameter portion 39a of the through hole 39 of the outside half 36.

The packing 40 is formed in a substantially ring-like shape having a through hole 40a. The packing 40 has an outer diameter substantially equal to the diameter of the large diameter portion 39a of the through hole 39 and an inner diameter somewhat smaller than a diameter of the wire 33. The packing 40 is set into the housing 35 in the following order. First, the packing 40 is fitted into the large diameter portion 39a of the outside half 36. Secondly, the inside half 37 is mounted on the projecting portion 38 of the outside half 36 so as to cover the large diameter portion 39a. Finally, the inside half 37 is fixed to the outside half 36 by means of screws. Thus, the wire insert hole 25 of the sealing member 26 is formed by the through hole 39 of the outside half 36, the through hole 40a of the packing 40, and the through hole 37a of the inside half 37.

The assembly of the outside half 36, the inside half 37 and the packing 40 is fixed to the left side wall 8 of the housing 2 by inserting the inside half 37 and the projecting portion 38 of the outside half 36 into the through hole 24 of the left side wall 8 and fixing the outside portion of the outside half 36 other than the projecting portion 38 to the left side wall 8 by means of screws. Similarly, the right sealing member 26 is also fixed to the right side wall 11 of the housing 2.

Reference numeral 41 designates a powder supply tank (partially shown in FIG. 1) for storing the powder, and reference numeral 42 designates a mixing tank. The powder supply tank 41 and the mixing tank 42 are fixed to an upper surface of an upper wall 43 of the housing 2. The and the mixing tank 42 is located at a substantially laterally central position of the upper wall 43.

A flexible feed tube 44 extends from the mixing tank 42 so as to be inserted through a hole of a cylindrical sealing member 45 fixedly engaged with a hole 43a formed through the upper wall 43 and be introduced into the housing 2. A lower end of the feed tube 44 is connected to a nozzle portion 47 of a spray nozzle 46.

The powder is supplied on occasion from the powder supply tank 41 to the mixing tank 42, so that a suitable amount of the powder is always stored in the mixing tank 42. On the other hand, a high-pressure air is supplied from an air compressor (not shown) to the mixing tank 42, and is mixed with the powder in the mixing tank 42. The mixture of the powder and the high-pressure air is fed under pressure to the spray nozzle 46.

The spray nozzle 46 includes the nozzle portion 47 mentioned above, a nozzle cover 51 covering the nozzle portion 47, and two connecting members 53 fixed to the nozzle cover 51.

The nozzle portion 47 is formed in a vertically elongated box-shape having a lower opening 47*a*. A transverse width of the nozzle portion 47 is relatively small. A lateral width of the nozzle portion 47 at its lower half is somewhat larger than that at its upper half. A laterally elongated nozzle tip 48 is fixedly mounted to the lower opening 47*a* of the nozzle portion 47. A lower end 48*a* of the nozzle tip 48 is formed as a spray hole having a narrowed transverse width.

A cylindrical tube connector 49 communicating with the inside of the nozzle portion 47 projects upwardly from an upper wall of the nozzle portion 47, and the lower end of the feed tube 44 is connected to the tube connector 49. Accordingly, the powder fed through feed tube 44 is introduced into the nozzle portion 47, and is sprayed downwardly from the spray hole 48*a* of the nozzle tip 48. The spray of the powder is in the form of a band having a suitable lateral length.

Reference numerals 50 designate two nut members fixed to a front side wall of the nozzle portion 47. The nut members 50 are located apart from each other in the lateral direction so that the axes of the nut members 50 are oriented in the transverse direction.

The nozzle cover 51 is larger in size than the nozzle portion 47, and it is formed in a box-shape having a lower opening. A front side wall of the nozzle cover 51 is formed with two vertically elongated holes 51*a* extending in parallel to each other. The nozzle portion 47 is located in the nozzle cover 51, and threaded portions of two screws 52 are inserted through the respective elongated holes 51*a* from the outside of the nozzle cover 51. The threaded portions of the two screws 52 are threadedly engaged with the respective nut members 50. Thus, by tightening each screw 52, the side edge portion of each elongated hole 51*a* is firmly nipped between the corresponding nut member 50 and a head portion of the corresponding screw 52, thus firmly supporting the nozzle portion 47 to the nozzle cover 51.

A vertical position of the nozzle portion 47 with respect to the nozzle cover 51 can be adjusted by loosening the screws 52.

An upper side wall of the nozzle cover 51 is formed with a hole 51*b*, and the tube connector 49 of the nozzle portion 47 is inserted through the hole 51*b* of the nozzle cover 51 to project upwardly.

The two connecting members 53 are fixed to the upper surface of the nozzle cover 51 at the right and left ends thereof. The connecting members 53 are respectively formed with mounting holes 53*a* extending in the transverse direction, and two sliding shafts 61 of a nozzle driving section 54 to be hereinafter described are fixedly engaged with the mounting holes 53*a* of the connecting members 53, respectively.

Figure 4:
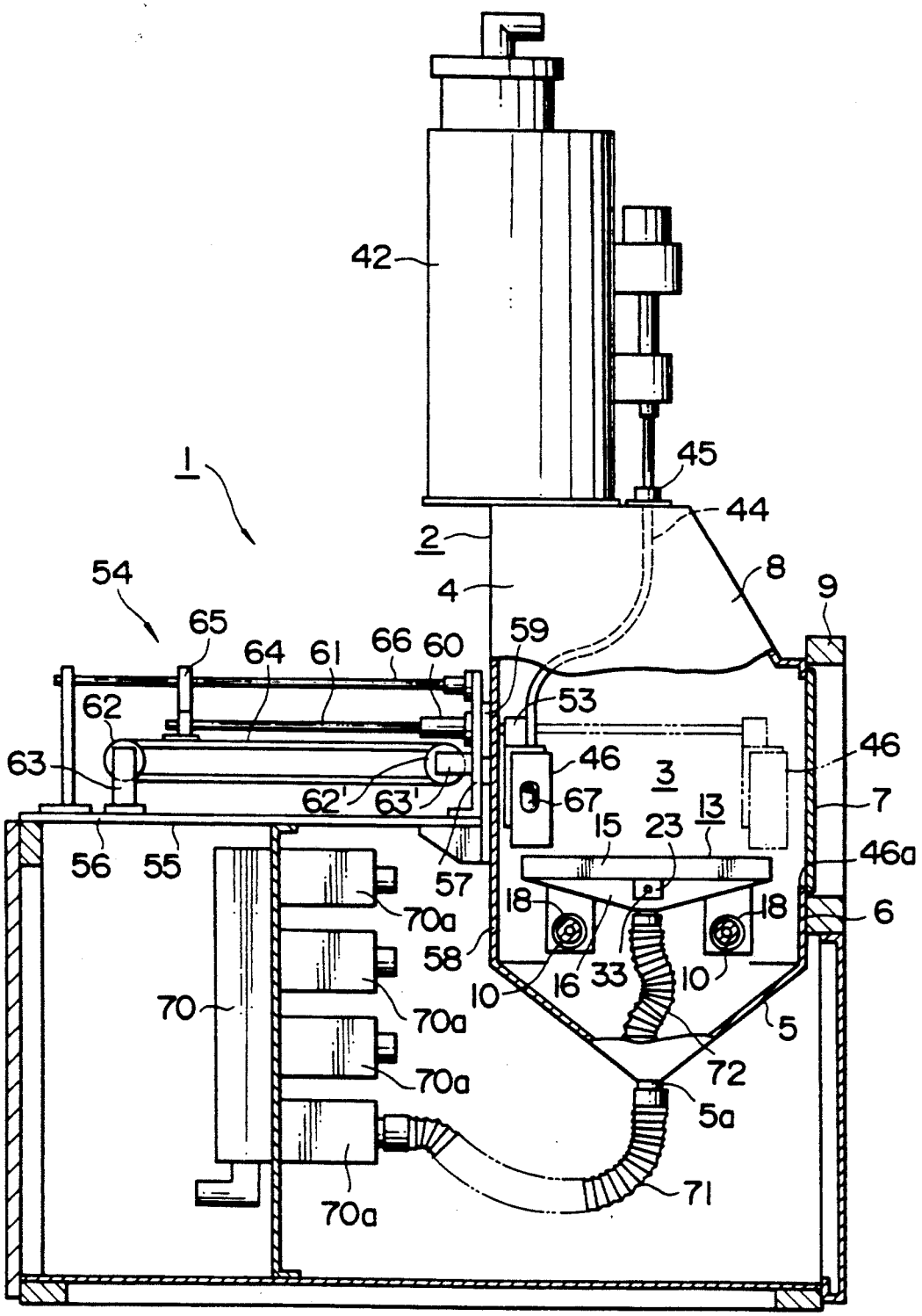
FIG. 4 is a cross-section taken along the line IV—IV in FIG. 1.
Figure 10:
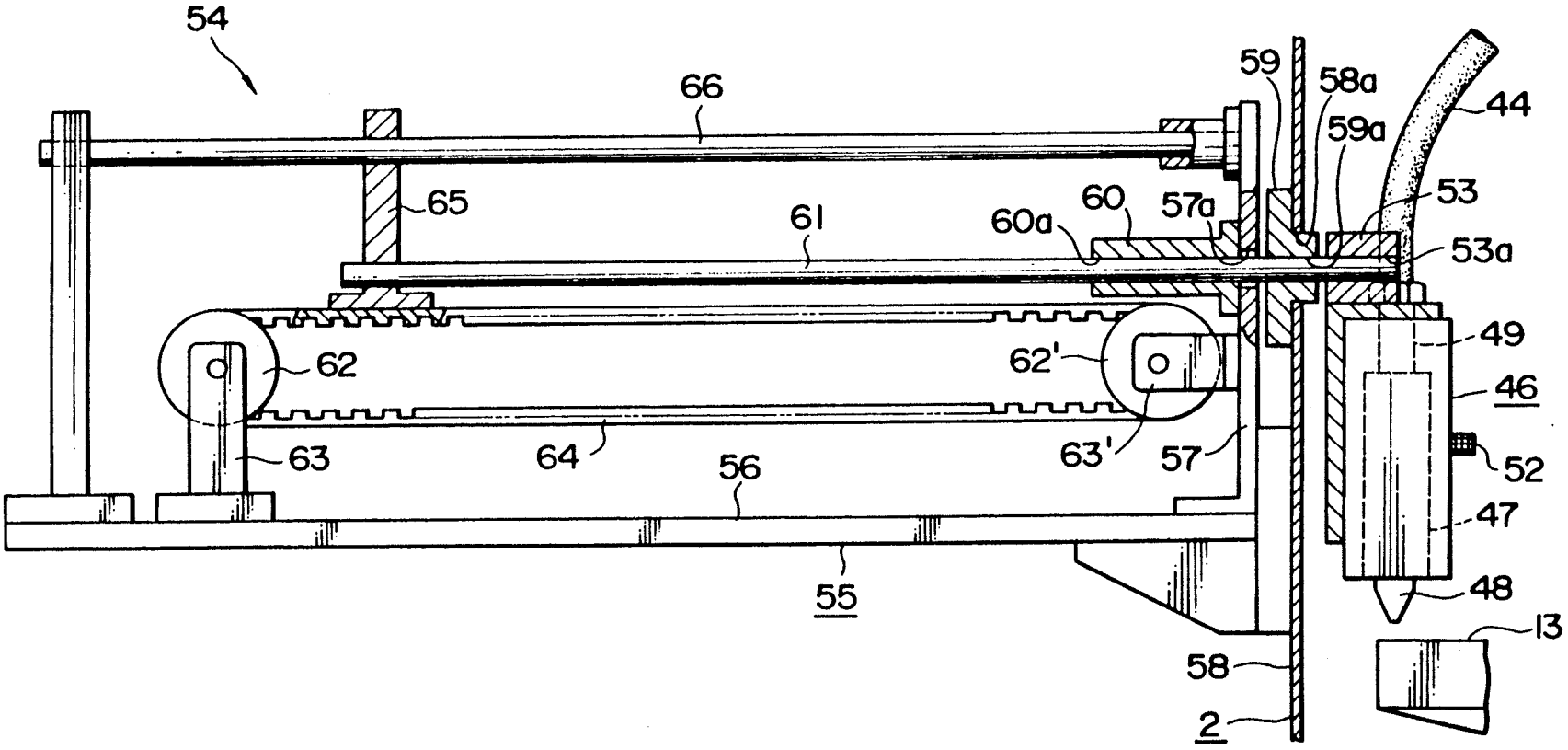
FIG. 10 is an enlarged side view, partially in section, showing a driving section for the spray nozzle.

Referring to FIGS. 4 and 10, the nozzle driving section 54 is provided to support the spray nozzle 46 and move the same in the transverse direction.

Reference numeral 55 designates a supporting base for the nozzle driving section 54. The supporting base 55 is mounted on the body frame 9 at a portion thereof behind the housing 2. The supporting base 55 is comprised of a horizontal bottom portion 56 and a vertical wall portion 57 standing from a front end of the bottom portion 56.

A rear side wall 58 of the housing 2 is formed at its substantially central portion with two holes 58*a* (one of which being shown in FIG. 10) spaced a suitable distance from each other in the lateral direction. Each hole 58*a* is closed by a sealing member 59 having a through hole 59*a*.

The vertical wall portion 57 of the supporting base 55 is formed with two through holes 57*a* (one of which being shown in FIG. 10) opposed to the respective holes 58*a* of the rear side wall 58.

Two linear guides 60 (one of which is shown in FIG. 10) each having a sliding shaft insert hole 60*a* are mounted on a rear surface of the vertical wall portion 57 in such a manner that the sliding shaft insert hole 60*a* is aligned with the corresponding through hole 57*a* of the vertical wall portion 57.

The two column like sliding shafts 61 each are slidably inserted through the respective sliding shaft insert holes 60*a* of the linear guides 60, the respective through holes 57*a* of the vertical wall portion 57, and the respective through holes 59*a* of the sealing members 59. The front end portions of the sliding shafts 61 are fixedly engaged with the respective mounting holes 53*a* formed through the connecting members 53 of the spray nozzle 46.

Thus, the spray nozzle 46 is supported through the sliding shafts 61 to the linear guides 60 at a position just over a locus of movement of the work bed 13 in such a manner as to be movable in the transverse direction, that is, in the direction perpendicular to the moving direction of the work bed 13.

Reference numerals 62 and 62′ denote two counter pulleys rotatably supported to supporting members 63 and 63′ projecting from a rear end portion of the bottom portion 56 and an intermediate portion of the vertical wall portion 57 of the supporting base 55, respectively. An endless timing belt 64 is wrapped between the two counter pulleys 62 and 62′.

One of the two counter pulleys 62 and 62′ is driven by a motor (not shown) to thereby drive the timing belt 64.

Reference numeral 65 designates a connecting member fixed to the timing belt 64. The rear end portions of the sliding shafts 61 are fixed to the connecting member 65. Accordingly, when the timing belt 64 is driven, the connecting member 65 is moved together with the sliding shafts 61 in the transverse direction.

The spray nozzle 46 is allowed to be moved between a retracted position shown by a solid line in FIG. 4 and an advanced position shown by a phantom line in FIG. 4.

Reference numeral 66 designates an auxiliary guide shaft supported to the supporting base 55 and extending in the transverse direction. The upper end portion of the connecting member 65 is slidably supported to the auxiliary guide shaft 66, thereby stably maintaining the attitude of the sliding shafts 61 and the spray nozzle 46 fixed thereto.

The blasting operation of the blasting apparatus 1 with respect to the substrate 14 is carried out in the following exemplary.

First, the substrate 14 is set on the work bed 13 as mentioned above.

As previously mentioned, the setting of the substrate 14 is carried out by first removing the work table 20 of the work bed 13 from the moving base 15, then placing the substrate 14 on the work table 20, and then mounting the work table 20 onto the moving base 15. Thereafter, the work window 6a is closed by the door 7 to substantially isolate the interior of the housing 2.

When an operation start command is generated, the work bed 13 is moved from the initial position toward the terminal position. In the course of the movement of the work bed 13, when the right end portion of the substrate 14 on the work bed 13 comes to a position opposed to a locus of movement of the spray nozzle 46, the movement of the work bed 13 is stopped.

Then, the spray nozzle 46 is advanced to a position opposed to the substrate 14. From this advanced position, the spray nozzle 46 starts to spray the powder and is further advanced, thereby effecting the blasting to the substrate 14 in a predetermined band-shaped region which extends in the transverse direction.

When the spray nozzle 46 comes to the final advanced position, the work bed 13 starts to be moved again toward the terminal position by a predetermined pitch, that is, the same distance as the lateral width of the spray hole 48a of the spray nozzle 46.

The spray nozzle 46 then is moved to the retracted position as spraying the powder, thereby effecting the blasting of another band-shaped region of the substrate 14.

Such pitch feed of the work bed 13 and movement of the spray nozzle 46 are repeated to thereby expose the entire surface of the substrate 14 to the spray. Accordingly, those portions of the substrate 14 other than those previously masked are eroded by the spray of the powder.

When the work bed 13 comes to the terminal position, it is returned to the initial position. Further, the spray of the powder from the spray nozzle 46 is stopped, and the spray nozzle 46 is returned to the retracted position to wait at this position.

Reference numerals 67 designate two hose connecting pipes projecting obliquely upwardly from the right and left side walls of the nozzle cover 51. The hose connecting pipes 67 are communicated with the inside of the nozzle cover 51. Two bellows-like recovery hoses 68 are connected at their lower ends to the hose connecting pipes 67, respectively, and the upper ends of the recovery hoses 68 are connected to the lower ends of two hose couplings 69 inserted through the upper side wall 43 of the housing 2, respectively. Further, two suction hoses (not shown) extending from a powder recovery section (not shown) are connected to the upper ends of the hose couplings 69, thereby evacuating the inside of the nozzle cover 51.

Accordingly, the powder sprayed from the spray nozzle 46 and which is reflected back off the substrate 14 is sucked from the space inside the nozzle cover 51 through the hose connecting pipes 67, the recover hose 68, the hose couplings 69 and the suction hoses to the powder recovery section.

Reference numeral 70 designates a valve block located behind the housing 2. The valve block 70 is connected to the powder recovery section, and it is provided with a plurality of powder valves 70a.

Reference numerals 71 and 72 designate recovery hoses similar to the above-mentioned recovery hoses 68. One end of the recovery hose 71 is connected to the hose connecting projection 5a formed at the bottom apex of the housing 2, and the other end is connected to one of the powder valves 70a of the valve block 70. On the other hand, one end of the recovery hose 72 is connected to the hose connecting projection 16c of the moving base 15 of the work bed 13, and the other end is connected to a hose coupling 73 inserted through the bottom portion 5 of the housing 2. The hose coupling 73 is connected through a connecting hose (not shown) to another one of the powder valves 70a.

Accordingly, the inside of the moving base 15 of the work bed 13 and the inside of the housing 2 are evacuated, so that a part of the powder sprayed from the spray nozzle 46 onto the substrate 14 other than the part sucked through the recovery hoses 68 is almost entirely sucked from the inside of the moving base 15 through the recovery hose 72 to the powder recovery section. Further, the powder which has scattered outside the work bed 13 and the nozzle cover 51, is sucked through the recovery hose 71 to the powder recovery section. Thus, all the powder sprayed from the spray nozzle 46 onto the substrate 14 is returned to the powder recovery section.

While the invention has been described with reference to a specific embodiment, the description is illustrative and is not to be construed as limiting the scope of the invention. Various modifications and changes may occur to those skilled in the art without departing from the spirit and scope of the invention as defined by the appended claims.

What is claimed is:

1. A blasting apparatus for spraying a powder against a work piece disposed in a blasting chamber, said blasting apparatus comprising:

a rigid movable workbed on which said work piece is disposable, said workbed comprising a rigid lower plate member which forms an integral part of the workbed, which extends the length of said workbed, which is movable synchronously with said workbed, and which has a funnel-shaped concave configuration adapted to collect powder, said plate member having a first opening formed at its lower apex through which powder can be exhausted;

a spray nozzle for spraying said powder onto said work piece;

first means for linearly moving said workbed in a first horizontal direction; and second means for linearly moving said spray nozzle in a second horizontal direction perpendicular to said first direction;

particulate matter collection means for collecting spent powder;

a first hose fluidly interconnecting the first opening formed at the lower apex of said lower plate member with said particulate matter collection means, said first hose being flexible and of sufficient length to allow for workbed movement;

a stationary funnel-shaped concavely configured panel which is adapted to collect powder and which is disposed below said workbed and formed with a second opening at its lower apex through which powder can be exhausted, said stationary funnel shaped concavely configured panel forming the floor of an enclosure which encloses said workbed and said spray nozzle; and a second hose fluidly interconnecting the second opening formed at the lower apex of said stationary funnel-shaped panel with said particulate matter collection means.

2. The blasting apparatus as defined in claim 1 further comprising a supply system for supplying said powder to said spray nozzle in said blasting chamber, said supply system having a flexible tube connected to said spray nozzle.

3. The blasting apparatus as defined in claim 2 further comprising a nozzle height adjusting mechanism for adjusting a height of said spray nozzle relative to said work.

4. The blasting apparatus as defined in claim 3 further comprising a sliding shaft for slidably supporting said work bed and a bellows-like cylindrical member for covering said sliding shaft.

5. The blasting apparatus as defined in claim 4, wherein said first means and said second means are provided outside said blasting chamber.

6. The blasting apparatus as defined in claim 5 further comprising a wire for connecting said work bed to said first means.

7. The blasting apparatus as defined in claim 4 further comprising a wire for connecting said work bed to said first means.

8. The blasting apparatus as defined in claim 3, wherein said first means and said second means are provided outside said blasting chamber.

9. The blasting apparatus as defined in claim 8 further comprising a wire for connecting said work bed to said first means.

10. The blasting apparatus as defined in claim 3 further comprising a wire for connecting said work bed to said first means.

11. The blasting apparatus as defined in claim 2 further comprising a sliding shaft for slidably supporting said work bed and a bellows-like cylindrical member for covering said sliding shaft.

12. The blasting apparatus as defined in claim 11, wherein said first means and said second means are provided outside said blasting chamber.

13. The blasting apparatus as defined in claim 12 further comprising a wire for connecting said work bed to said first means.

14. The blasting apparatus as defined in claim 11 further comprising a wire for connecting said work bed to said first means.

15. The blasting apparatus as defined in claim 2, wherein said first means and said second means are provided outside said blasting chamber.

16. The blasting apparatus as defined in claim 15 further comprising a wire for connecting said work bed to said first means.

17. The blasting apparatus as defined in claim 2 further comprising a wire for connecting said work bed to said first means.

18. The blasting apparatus as defined in claim 1 further comprising a nozzle height adjusting mechanism for adjusting a height of said spray nozzle relative to said work.

19. The blasting apparatus as defined in claim 18 further comprising a sliding shaft for slidably supporting said work bed and a bellows-like cylindrical member for covering said sliding shaft.

20. The blasting apparatus as defined in claim 19, wherein said first means and said second means are provided outside said blasting chamber.

21. The blasting apparatus as defined in claim 20 further comprising a wire for connecting said work bed to said first means.

22. The blasting apparatus as defined in claim 19 further comprising a wire for connecting said work bed to said first means.

23. The blasting apparatus as defined in claim 18, wherein said first means and said second means are provided outside said blasting chamber.

24. The blasting apparatus as defined in claim 23 further comprising a wire for connecting said work bed to said first means.

25. The blasting apparatus as defined in claim 18 further comprising a wire for connecting said work bed to said first means.

26. The blasting apparatus as defined in claim 1 further comprising a sliding shaft for slidably supporting said work bed and a bellows-like cylindrical member for covering said sliding shaft.

27. The blasting apparatus as defined in claim 26, wherein said first means and said second means are provided outside said blasting chamber.

28. The blasting apparatus as defined in claim 27 further comprising a wire for connecting said work bed to said first means.

29. The blasting apparatus as defined in claim 26 further comprising a wire for connecting said work bed to said first means.

30. The blasting apparatus as defined in claim 1, wherein said first means and said second means are provided outside said blasting chamber.

31. The blasting apparatus as defined in claim 30 further comprising a wire for connecting said work bed to said first means.

32. The blasting apparatus as defined in claim 1 further comprising a wire for connecting said work bed to said first means.

33. The blasting apparatus as claimed in claim 1, wherein said spray nozzle comprises:

a cover having an elongate opening in a lower portion thereof through which powder can be ejected toward a work piece which is spaced from said cover and disposed on said workbed;

a nozzle adjustably supported within said cover, said nozzle being fluidly communicated with a source of powder and air under pressure by way of a connector tube which passes through an upper portion of said cover, the powder and the air being introduced into a chamber defined in said nozzle, said nozzle having a narrow elongate essentially rectangular shaped nozzle tip at a lower end thereof, said nozzle tip being arranged to eject powder out of said elongate cover by way of said elongate opening; and port means formed in said cover through which powder in the cover can sucked out of the space defined between said nozzle and said cover and transferred to said particulate matter collection means by way of recovery conduiting means, said port means being formed at a location intermediate of upper and lower portions of said cover.

34. The blasting apparatus as claimed in claim 33, wherein a bottom portion of said nozzle in which said nozzle tip is formed is wider than an upper portion of said nozzle in which said powder inlet is formed.

35. The blasting apparatus as claimed in claim 33, wherein said nozzle is arranged so that its elongate dimension is oriented in said first direction.

36. The blasting apparatus comprising:

a linearly movable essentially horizontal workbed which is adapted to stationarily support a work piece, said workbed having an integral concave essentially funnel-shaped lower panel member which is rigid with said workbed and which is so shaped and configured as to collect particulate material, said lower panel member extending the length of said workbed;

first drive means for selectively moving said linearly movable workbed linearly in a first essentially horizontal direction;

a spray nozzle for spraying a particulate material downward toward said workbed;

spray nozzle drive means for linearly moving said spray nozzle in a second essentially horizontal direction which is perpendicular to said first direction.

37. A blasting apparatus as set forth in claim 36, wherein said spray nozzle has a narrow orifice through which powder is ejected, said nozzle being elongate in said first essentially horizontal direction, and spaced from the workbed and a work piece which is supported thereon.

38. A blasting apparatus as set forth claim 37, wherein said spray nozzle comprises a body in which said orifice is formed, and a cover which encloses said body and defines a space thereabout, said cover having an opening through which powder can be ejected, said cover being fluidly communicated with conduit means via which powder between said cover and said body can be removed.

39. A blasting apparatus for fusillading particulate matter against a work piece, comprising:

an enclosure;

particulate matter collection means;

a stationary funnel-shaped floor panel which forms part of said enclosure and in which a first particulate matter exhaust opening is formed, said first opening being fluidly communicated with a particulate matter collection means by way of a first hose;

a horizontally movable and oriented workbed on which a work piece can be disposed and maintained in a stationary state with respect to said workbed, said workbed being disposed within said enclosure and provided with:

a lower funnel-shaped panel which forms an integral part of said workbed and which is located below the work piece and arranged to collect particulate matter, and a second particulate matter exhaust opening in said lower funnel-shaped panel through which particulate matter can be exhausted to said particulate matter collection means through a second flexible hose;

a spray nozzle for fusillading particulate matter vertically down onto the work piece which is stationarily supported on said workbed;

first means for linearly moving said workbed within said enclosure in a first horizontal direction, said first linearly moving means including a wire which is operatively connected with said workbed, which passes a side wall of said enclosure and which is connected with a driven pulley located outside of said enclosure;

second means for linearly moving said spray nozzle within said enclosure in a second horizontal direction perpendicular to said first direction; and a cover enclosing said nozzle, said cover being spaced above said workbed so as to be in a contact-free relationship with the work piece on said workbed, said cover having a third port which is fluidly communicated with said particulate matter collection means through a third flexible hose, said port being adapted to suck particulate matter out of a space defined by said cover about said nozzle.

* * * * *